United States Patent [19]

Shimada

[11] Patent Number: 4,778,962

[45] Date of Patent: Oct. 18, 1988

[54] DEVICE FOR OPENING SEAL OF PACKAGE

[75] Inventor: Katsuyuki Shimada, Takarazuka, Japan

[73] Assignee: Kinki Insatsu Kabushiki Kaisha, Osaka, Japan

[21] Appl. No.: 851,145

[22] Filed: Apr. 11, 1986

[30] Foreign Application Priority Data

Apr. 30, 1985 [JP] Japan ..... 60-065240[U]

[51] Int. Cl.[4] ..... B65D 85/10

[52] U.S. Cl. ..... 206/254

[58] Field of Search ..... 206/254, 249

[56] References Cited

U.S. PATENT DOCUMENTS

| | | | |
|---|---|---|---|
| 381,889 | 4/1888 | Scott | 206/254 X |
| 1,132,781 | 3/1915 | Lile | 206/804 X |
| 1,928,663 | 10/1933 | Georger | 206/254 |
| 1,951,343 | 3/1934 | Butt et al. | 206/264 X |
| 2,129,887 | 9/1938 | Tamarin | 206/250 X |
| 2,258,170 | 10/1941 | Austin et al. | 206/254 |
| 2,415,117 | 2/1947 | Tamarin | 206/264 X |
| 2,453,777 | 11/1948 | Bell | 206/264 X |
| 2,675,169 | 4/1954 | Tamarin | 206/613 |
| 2,845,213 | 7/1958 | Tamarin | 206/264 X |
| 2,928,571 | 3/1960 | Caruso | 206/254 |
| 3,260,405 | 7/1966 | Frischer et al. | 206/254 |
| 3,923,239 | 12/1975 | Lee | 206/264 X |
| 4,444,308 | 4/1984 | MacEwen | 206/804 X |

FOREIGN PATENT DOCUMENTS

| | | | |
|---|---|---|---|
| 532051 | 10/1954 | Belgium | 206/254 |
| 676480 | 6/1939 | Fed. Rep. of Germany | 206/254 |
| 857778 | 12/1952 | Fed. Rep. of Germany | 206/254 |
| 67350 | 2/1958 | France | 206/254 |
| 190004 | 6/1937 | Switzerland | 206/254 |
| 195806 | 8/1938 | Switzerland | 206/254 |
| 207817 | 4/1940 | Switzerland | 206/254 |
| 780210 | 7/1957 | United Kingdom | 206/254 |

*Primary Examiner*—Joseph Man-Fu Moy

*Attorney, Agent, or Firm*—Wenderoth, Lind & Ponack

[57] ABSTRACT

This invention relates to a device for opening the seal of a cigaret package of the type enclosed by a folded packaging sheet having a score line on the top thereof. The device comprises a seal opening and cigaret removing device having a contacting member integrally formed at the upper end thereof with a cigaret top contacting piece and a seal opening and cigaret removing tongue piece. The device has at the lower end thereof a side contacting piece formed with a cigaret bottom contacting piece and at the side end thereof a side contacting piece. The score line on the upper surface of the package is broken by the cigaret top contacting piece when pulling the tongue piece upwardly. Thus, the package can be simply opened by breaking the seal in one step, and one or more cigarets are projected above the package by further lifting the tongue piece. The contacting member and the side contacting piece ensure that one or more cigarets are evenly withdrawn from the package to allow one to readily grasp the one or more cigarets.

14 Claims, 5 Drawing Sheets

Fig. 2·A

DEVICE FOR OPENING SEAL OF PACKAGE

BACKGROUND OF THE INVENTION

This invention relates to a device for opening the seal of a cigaret package and, more particularly, to a structure for simply opening the sealing of a package so as to readily pull out one or more cigarets from the cigaret package.

PRIOR ART

Heretofore, a conventional cigaret package is sealed by folding the upper portions of both lateral right and left sides of a moistureproof packaging sheet of rectangular shape enclosed at the lower end, then the upper portions of longitudinal front and rear sides so as to coat the upper surfaces of cigarets, and bonding an enclosing seal over the upper ends of a sheath such as printed with the trade name of the cigarets on the central portion of the upper folded portion of a longitudinal strip or band.

When a user opens the seal of the cigaret package, he ordinarily opens either one of right and left sides of the seal enclosing the package by inserting the end of the finger into the lower portion of the folded part of the upper portion of the longitudinal strip or band, then breaking the folded part of the upper portion along the seal, and then erecting the folded part of the upper end of the strip and the folded part of the upper end of the lateral strip or band, thereby opening the seal of the package. This opening operation of the package is complicated. Even when one or more cigarets are pulled out from the opened package, the tops of the cigarets cannot be held or grasped directly by the fingers to pull out the cigarets. Then, the bottom of the package is struck by the finger to project the upper ends of the cigarets, and one or more the cigarets are then removed from the package. Thus, it was difficult to remove one of the cigarets from the package.

SUMMARY OF THE INVENTION

It is therefore an object of the present invention to provide a device for simply pulling out one or more cigarets from a cigaret package by eliminating the abovementioned disadvantages and drawbacks of the conventional cigaret package and simply cleaving the folded part of the upper end of longitudinal strip or band of the package along the seal of the package, readily opening the folded part of the upper end of lateral strip or band by one step and simultaneously removing one of the cigarets from the opened seal of the package.

In order to achieve the above object of this invention, there is provided a device for opening the seal of a cigaret package comprising a side cigaret contacting member contacted with the either inner surface of the right and left sides of the package, and a seal opening and cigaret removing device formed integrally with a side contacting piece integrally formed with the contacting member in contact with the inner surface of the front and rear sides of the package, a cigaret top contacting piece integrally formed with a seal opening and cigaret removing tongue piece at the end in contact with the tops of cigarets at the upper end of the contacting member, and a cigaret bottom contacting piece in contact with the bottoms of the cigarets at the lower end of the side contacting piece to be packed together with the cigarets in the package.

When the seal opening and cigaret removing device is enclosed together with cigarets, a suitable number of cigarets is contacted at the left or right side with the contacting member, at the front and rear sides with the side contacting pieces, at the upper and lower sides with the upper and lower contacting pieces, and enclosed by a moistureproof packaging sheet by a conventional cigaret packaging machine in the same manner as the conventional cigaret package. When sealing the upper portion of the package, the tongue piece is first erect perpendicular to the contacting piece, the upper ends of the right and left sides of the package sheet are folded onto the upper contacting piece and the cigaret top surface, the tongue piece is then brought in contact with the folded part of the right and left sides of the upper contacting piece, the upper ends of the front and rear sides of the packaging sheet are folded to cover the tongue piece from above, a sealing strip or band is bonded over the upper ends of the front and rear sides of the sheath at the center on the upper surface of the folded parts of the front and rear sides of the contacting piece, and score lines are perforated along the sealing strip above the folding line of the upper contacting piece and the tongue piece of the folded parts of the front and rear sides of the contacting piece.

When the package thus sealed is opened, the tongue piece projecting from the end from the trapezoidal folded part above the front and rear sides folded previously at the right and left sides of the package is erected. Then, the score lines perforated at the folding lines between the upper contacting piece of the folded parts of the front and rear sides and the tongue piece are cloven, and the folded parts at the front and rear sides which cover the tongue piece are erected. When the tongue piece is further erected to lift the upper contacting piece, the folded parts of the upper contacting piece of the folded parts at the right and left sides are erected to simply open the package.

When one or more cigarets are removed from the package, the tongue piece is further pulled out from the open state to lift the contacting member and the side contacting piece. The cigarets placed on the lower contacting piece at the lower end of the side contacting piece are readily projected at the top from the opened seal above the package, and simply removed.

BRIEF DESCRIPTION OF THE DRAWINGS

FIGS. 2A and 2B are perspective views showing a first embodiment of a device for opening the seal of a cigaret package according to this invention further illustrating the seal opening sequence of the package; wherein FIG. 2A shows the state that a score line of a sealed section is cloven, and FIG. 2B shows the opened state;

FIGS. 3A and 3B are perspective views showing the state where one or more cigarets are being pulled; wherein FIG. 3A is a front view and FIG. 3B is a back view;

wherein FIG. 6A is a front view and FIG. 6B is a back view;

DESCRIPTION OF THE PREFERRED EMBODIMENTS

Embodiments of this invention will be described in detail with reference to the accompanying drawings.

Figure 3A:
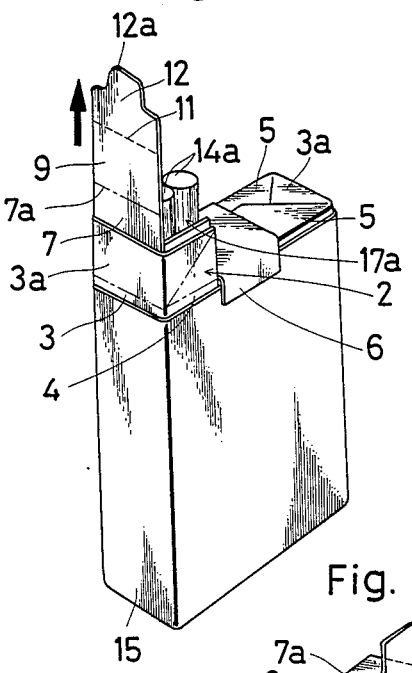
Figure 3B:
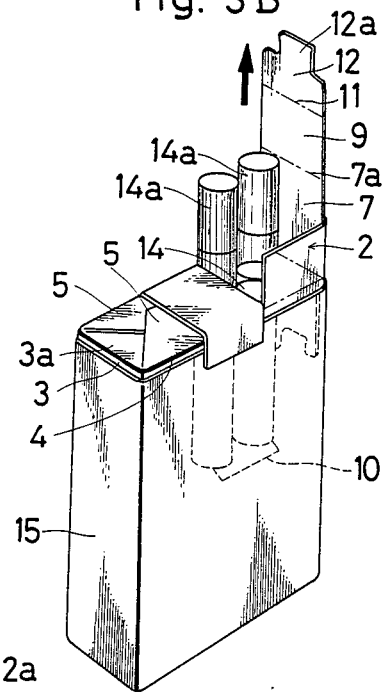
Figure 4:
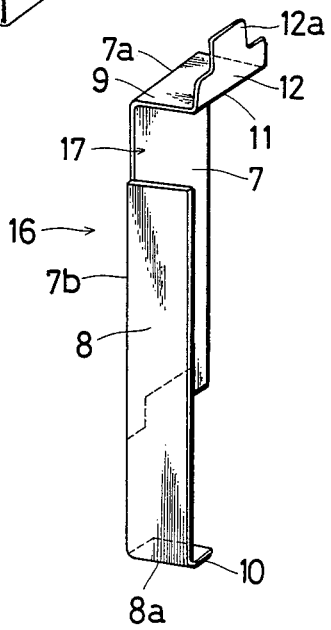
FIG. 4 is a perspective view of a seal opening and cigaret removing device.

In FIGS. 1 to 5, reference numeral 1 designates a known cigaret package in which twenty cigarets 14 are enclosed at the side periphery by a moistureproof packaging sheet 2 in a rectangular parallelepiped shape, sealed at the bottom, and formed at the upper rectangular-sectional opening portion in such a manner that the upper parts of the right and left sides 3 of the sheet 2 are inwardly folded in contact with the tops of the cigarets 14, the upper parts of the front and rear sides 4 of the sheet 2 are folded in a trapezoidal shape, and the folded parts 5 of the trapezoidal parts of the sheet 2 are respectively folded on the upper surfaces of the upper folded parts 3*a* of the right and left sides 3 inwardly folded on the sheet 2; a sheath 15 printed with a trade name of the cigaret is bonded on the side periphery except the upper surface of the package 1, and a sealing strip 6 is bonded on the parts corresponding to the upper ends of the front and rear sides 4 of the sheet 2 at the sheath 15 at the center of the upper surfaces of the trapezoidal folded parts 5 and 5 of the sheet 2. Reference numeral 7 designates a longitudinal member or cigaret side contacting member, which is formed in width to contact with either inner surface of the right and left sides 3 of the package 1. Reference numeral 8 designates a side contacting piece integrally formed through a folding line 7*b* with one side of the contacting member 7 to be contacted with either inner surface of the front and rear sides 4 of the package, and formed in width equal to the length of an upper contacting piece 9 to be described in detail. Upper contacting or cigaret top contacting piece 9 is integrally formed through a folding line 7*a* with the upper end of the contacting member 7, and formed in length to place on the top of the cigarets 14 between either upper end of the right and left sides 3 in contact with the contacting member 7 and the sealing strip 6. Reference numeral 10 designates a cigaret bottom contacting piece integrally formed through a folding line 8*a* with the lower end of the contacting piece 8, and formed in length to place one of cigarets 14. Reference numeral 12 designates a package opening and cigaret removing tongue piece integrally formed through a folding line 11 with the end of the contacting piece 9 and formed with a projection 12*a* to be contacted at the end with the end of a finger. Reference numerals 13 designate score lines respectively formed along the strip 6 above the folding line 11 between the tongue piece 12 and the contacting piece 9 on the trapezoidal folded parts 5 of the sheet 2 above the front and rear sides 4 of the package 1. Reference numeral 16 designates a seal opening and cigaret removing device, which is formed of the contacting member or piece 7, the contacting piece 9, the contacting piece 10 and the tongue piece 12, and folded at the folding lines 7*a*, 7*b*, 8*a* and 11 as shown in FIG. 4. Reference numeral 17 designates a cigaret removing outlet formed by cutting out the upper part of the contacting piece 8.

Figure 6A:
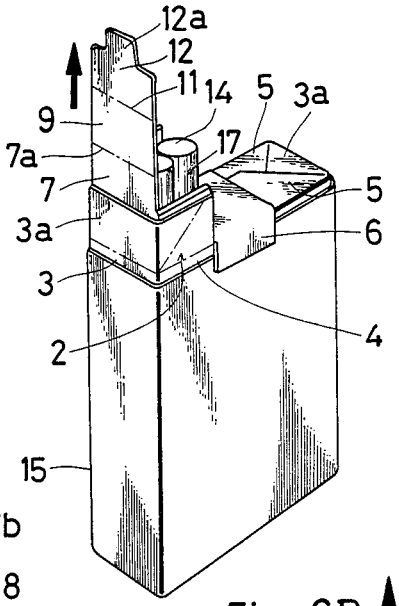
FIGS. 6A and 6B are perspective views showing a second embodiment of a device for opening the seal of a cigaret package according to this invention illustrating the state one or more cigarets are being pulled.
Figure 6B:
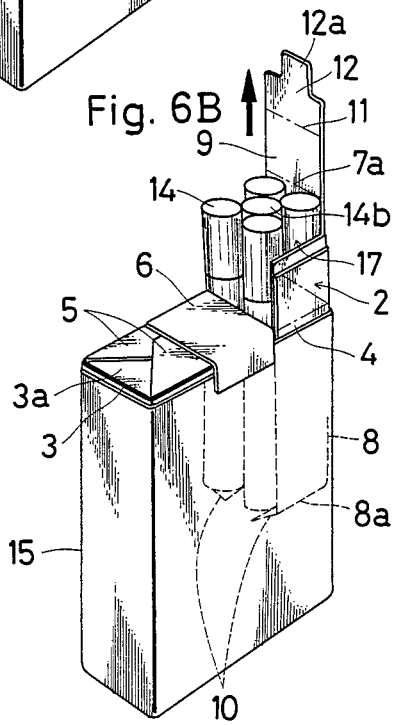
Figure 7:
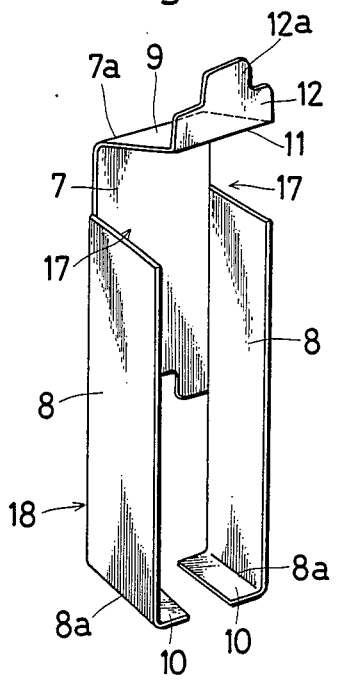
FIG. 7 is a perspective view of a seal opening and cigaret removing device of the second embodiment of the invention.
Figure 8:
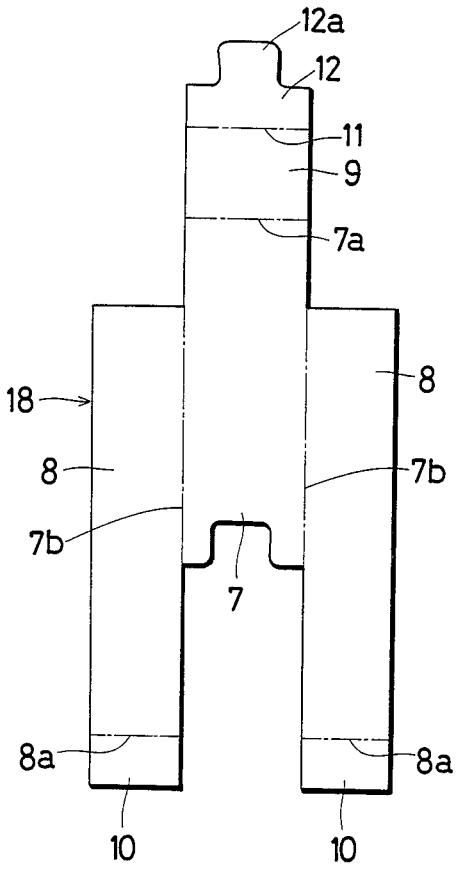
FIG. 8 is a developed view of the seal opening and cigaret removing device of the second embodiment.

FIGS. 6 to 8 show second embodiment of this invention. In the second embodiment, side contacting pieces 8, formed similarly to the first embodiment to be contacted through folding lines 7*b* with both sides of the contacting piece 7 formed similarly to the first embodiment, are respectively formed integrally with the inner surfaces of both the front and rear sides 4 of the package 1. The lower surface contacting pieces 10 formed similarly to the first embodiment are respectively formed integrally through folding lines 8*a* with the lower ends of the contacting pieces 8, the upper parts of the contacting pieces 8 are cut out to form cigaret removing outlets or parts 17 formed similarly to the first embodiment, and bent at the folding lines 7*a*, 7*b*, 7*b*, 8*a*, 8*a*and 11 as shown in FIG. 7 to form a seal opening and cigaret removing device 18.

Figure 9:
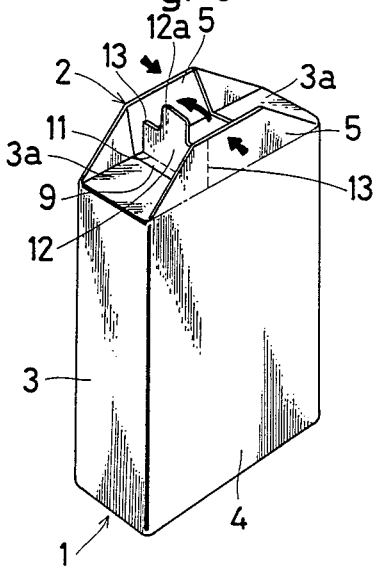
FIG. 9 is a perspective view showing the sealing sequence of the upper opening section of the package.

When the seal opening and cigaret removing device 16 (first embodiment) or 18 (second embodiment) is enclosed together with arranged twenty cigarets 14, the device 16 or 18 is formed in the shape as shown in FIG. 4 or 7, twenty cigarets 14 are contacted at the left side with the contacting member 7, at the front (first embodiment) or both the front and rear sides (second embodiment) with the contacting piece 8 (first embodiment) or contacting pieces 8 and 8 (second embodiment), respectively, at the upper and lower sides with the upper and lower contacting pieces 9 and 9, 10 and 10, respectively, and enclosed by a moistureproof packaging sheet 2 by a cigaret packaging machine in the same manner as the conventional cigaret package, and further sealed at the bottom. When sealing the upper opening portion of the cigaret package, as shown in FIG. 9, when the tongue piece 12 is first erect, perpendicular to the contacting piece 9, the upper folded parts 3*a* and 3*a* of the right and left sides 3 and 3 of the package 1 are inwardly folded, the tongue piece 12 at the end of the contacting piece 9 is superposed on the upper folded part 3*a* of the left side 3, and the trapezoidal folded parts 5 and 5 perforated with score lines 13 and 13 at the front and rear sides 4 and 4 are folded on the tongue piece 12. Then, the projection 12*a* at the end of the tongue piece 12 projects leftward of the folded parts 5 and 5 of the package 1, the sheath 15 (as designated in FIG. 36) printed with a trade name of the cigarets is covers the outer peripheral surface except the upper surface of the package 1, and the sealing strip 6 is bonded over the sheath 15 disposed on the upper ends of the front and rear sides 4 and 4 of the package 1 at the center on the upper surfaces of the trapezoidal folded parts 5 and 5 of the package 1 thus sealed as shown in FIG. 1.

Figure 1:
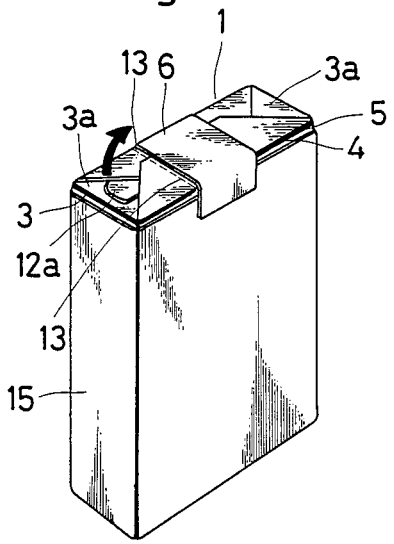
FIG. 1 is a perspective view of a cigaret package just prior to opening.
Figure 1:
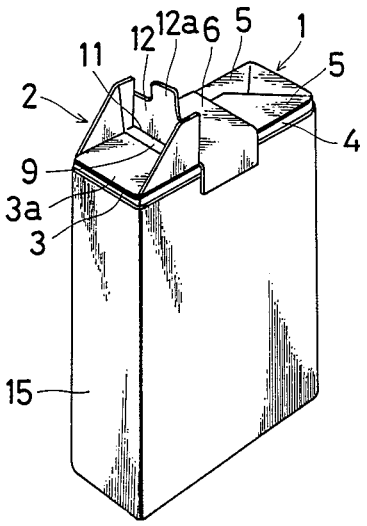
Figure 2B:
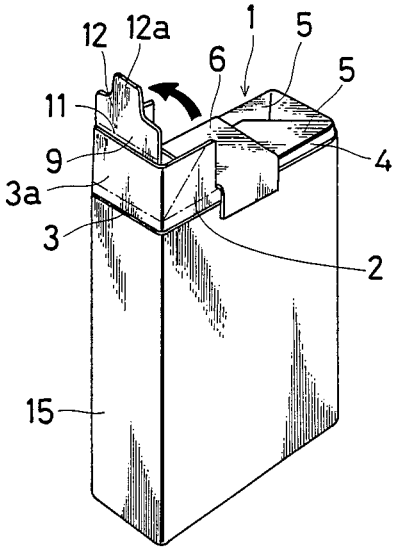

When the package 1 thus sealed as shown in FIG. 1 is opened, a finger tip is brought into contact with projection 12*a* projected at the side of the trapezoidal folded parts 5 and 5, the tongue piece 12 is erected at the folding line 11 from the contacting piece 9 as an axis. Then, score lines 13 and 13 perforated at the folded parts 5 and 5 of the package 1 are cloven as shown in FIG. 2A, and the folded parts 5 and 5 at the sides of score lines 13 and 13 are erected. When the tongue piece 12 is further erected, the contacting piece 9 is erected together with the folded part 3*a* of the left side 3 folded on the contacting piece 9 as shown in FIG. 2B, and the package 1 is thus opened by one step.

When one or more cigarets 14 are removed from the package 1, the tongue piece 12 is further pulled out from the position shown in FIG. 2B. Then, the contacting member 7 is lifted along the inner surface of the left side 3 of the package 1. As shown in FIGS. 3A and 3B, two cigarets 14*a* and 14*a* on the contacting piece 10 at the lower end of the contacting piece 8 are projected from the package 1, as further shown in FIGS. 6A and 6B, two cigarets 14*a* and 14*a* on the respective contacting pieces 10 and 10 opposed at the lower ends with the contacting pieces 8 and 8 as well as a cigaret 14*b* at the center; in total five cigarets 14 are projected from the package 1, can be grasped from the outlets 17 and 17, and removed out of the package 1 by one step.

After the package 1 is opened, two or five cigarets 14*a*, 14*a* and 14*b* are removed, the device 16 or 18 is removed at a suitable time, destroyed and discarded, and one or more cigarets can be removed from the package in the same manner as the conventional package.

Figure 5:
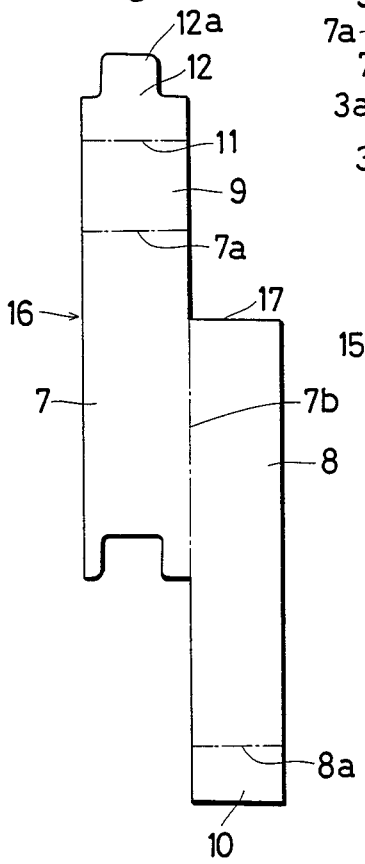
FIG. 5 is a developed view of the seal opening and cigaret removing device of FIG. 4.
Figure 10A:
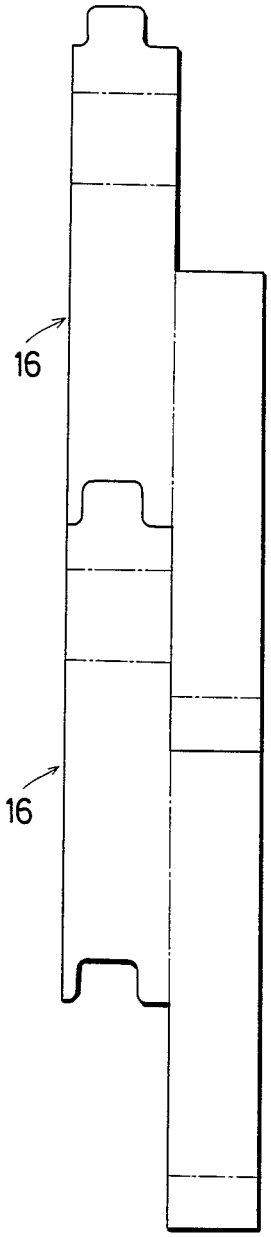
FIGS. 10A and 10B are plan views showing the cut state from paper of the seal opening and cigaret removing device.
Figure 10B:
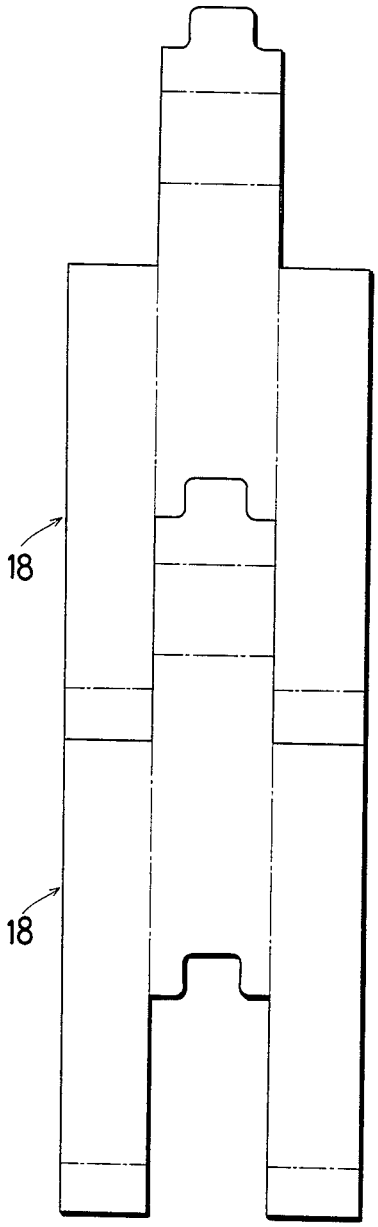

As shown in FIGS. 5 and 8, the lower end of the contacting member 7 is recessed upward so as to allow for continuous cutting of the material of one paper sheet into a number of devices 16 or 18 having the projections 12*a* corresponding to the recesses at the lower ends without waste. The case of cutting the devices 16 or 18 as shown in FIGS. 10A and 10B is achieved.

What is claimed is:

1. A device for opening the seal of and for pulling out cigarets from a cigaret package of the type enclosed by a folded packaging sheet having a score line on the top thereof, the device comprising:

a longitudinal member having upper and lower ends;

an upper piece integrally connected at one end thereof to the upper end of said longitudinal member;

a tongue piece integrally connected at one end thereof to the other end of said upper piece;

a first side piece having upper and lower ends, and integrally connected at the upper end thereof to a middle portion of said longitudinal member and at one side thereof;

a first bottom piece for contacting and supporting at least one cigaret, and integrally connected to the lower end of said first side piece;

said longitudinal member and said upper piece substantially extending the width of the cigaret package; and said first side piece extending beyond the lower end of said longitudinal member, the lower end of said first side piece and said first bottom piece being longitudinally spaced from the lower end of said longitudinal member.

2. The device of claim 1, wherein the connection of said first side piece to said longitudinal member at the middle portion thereof is spaced longitudinally from the upper end of said longitudinal piece and from said upper piece, the upper end of said side piece and said upper piece defining an opening therebetween, whereby a cigaret may pass therethrough.

3. The device as in claim 2, further comprising:

a second side piece having upper and lower ends, and integrally connected at the upper end thereof to the middle portion of said longitudinal member at the other side thereof;

a second bottom piece for contacting and supporting at least one cigaret, and integrally connected to the lower end of said second side piece;

the connection of said second side piece to said longitudinal member at the middle portion thereof is spaced longitudinally from the upper end of said longitudinal piece and from said upper piece, the upper end of said second side piece and said upper piece defining an opening therebetween, whereby a cigaret may pass therethrough.

4. The device as in any one of claims 1, 2, or 3, further comprising:

a projection integrally connected to the free end of said tongue piece, said projection having a width less than the width of said tongue piece.

5. The device as in one of claims 1, 2, or 3, further comprising:

a recess in the lower end of said longitudinal member, said recess having a width substantially the same as the width of said projection.

6. The device of claim 4, further comprising:

a recess in the lower end of said longitudinal member, said recess having a width substantially the same as the width of said projection.

7. A cigaret package of the type enclosed by the folded packaging sheet having a score line on the top thereof, said cigaret package comprising:

a device for opening the seal of and for pulling out cigarets from said cigaret package; said device further comprising:

a longitudinal member having upper and lower ends;

an upper piece integrally connected at one end thereof to the upper end of said longitudinal member;

a tongue piece integrally connected at one end thereof to the other end of said upper piece;

a first side piece having upper and lower ends, and integrally connected at the upper end thereof to a middle portion of said longitudinal member and at one side thereof;

a first bottom piece for contacting and supporting at least one cigaret, and integrally connected to the lower end of said first side piece;

said longitudinal member and said upper piece substantially extending the width of the cigaret package; and said first side piece extending beyond the lower end of said longitudinal member, the lower end of said first side piece and said first bottom piece being longitudinally spaced from the lower end of said longitudinal member.

8. The cigaret package of claim 7, wherein the connection of said first side piece to said longitudinal member at the middle portion thereof is spaced longitudinally from the upper end of said longitudinal piece and from said upper piece, the upper end of said side piece and said upper piece defining an opening therebetween, whereby a cigaret may pass therethrough.

9. The cigaret package as in claim 8, further comprising:

a second side piece having upper aad lower ends, and integrally connected at the upper end thereof to the middle portion of said longitudinal member at the other side thereof;

a second bottom piece for contacting and supporting at least one cigaret, and integrally connected to the lower end of said second side piece;

the connection of said second side piece to said longitudinal member at the middle portion thereof is spaced longitudially from the upper end of said longitudinal piece and from said upper piece, the upper end of said second side piece and said upper piece defining an opening therebetween, whereby a cigaret may pass therethrough.

10. The cigaret package as in any one of claims 7, 8, or 9, further comprising:

a projection integrally connected to the free end of said tongue piece, said projection having a width less than the width of said tongue piece; and

11. The cigaret package as in any one of claims 7, 8, or 9, further comprising:

a recess in the lower end of said longitudinal member, said recess having a width substantially the same as the width of said projection.

12. The cigaret package of claim 10, further comprising:

a recess in the lower end of said longitudinal member, said recess having a width substantially the same as the width of said projection.

13. The cigaret package as in any one of claims 7, 8, or 9, wherein said upper piece and said tongue piece are interposed between said folded packaging sheet and said cigaret package at the top thereof.

14. The cigaret package as in any one of claims 7, 8, or 9, wherein the integral connection between said upper piece and said tongue piece is at a distance from the free end of said tongue piece, the distance being substantially equal to the distance between the score line in the packaging sheet on the top of the cigaret package and one of the top edges of the package.

* * * * *